US005352242A

United States Patent [19]

Lämmermann et al.

[11] Patent Number: 5,352,242

[45] Date of Patent: Oct. 4, 1994

[54] FORMALDEHYDE-FREE EASY CARE FINISHING OF CELLULOSE-CONTAINING TEXTILE MATERIAL

[75] Inventors: Dieter Lämmermann, Hofheim/Taunus; Bernhard Mees, Eppstein/Taunus, both of Fed. Rep. of Germany

[73] Assignee: Hoechst Aktiengesellschaft, Frankfurt am Main, Fed. Rep. of Germany

[21] Appl. No.: 70,566

[22] Filed: Jun. 2, 1993

[30] Foreign Application Priority Data

Jun. 2, 1992 [DE] Fed. Rep. of Germany ..... 4218091

[51] Int. Cl.[5] ..... D06M 13/00

[52] U.S. Cl. ..... 8/120

[58] Field of Search ..... 8/120

[56] References Cited

U.S. PATENT DOCUMENTS 3,526,048 8/1970 Rowland et al. ..... 38/144

4,820,307 4/1989 Welch et al. ..... 8/120

5,199,953 4/1993 Fung et al. ..... 8/120

FOREIGN PATENT DOCUMENTS 0354648 2/1990 European Pat. Off. .

OTHER PUBLICATIONS

European Search Report Sep. 29, 1993, No. 93108577.3.

*Primary Examiner*—John Niebling
*Assistant Examiner*—Edna Wong
*Attorney, Agent, or Firm*—Connolly and Hutz

[57] ABSTRACT

The present invention relates to a process for the formaldehyde-free easy care finishing of cellulose-containing textile material by treating the cellulose-containing textile material with an aqueous liquor containing a polycarboxylic acid crosslinker and a crosslinking catalyst, then drying and heat treating, which comprises using boric acid or a derivative thereof as the crosslinking catalyst.

11 Claims, No Drawings

FORMALDEHYDE-FREE EASY CARE FINISHING OF CELLULOSE-CONTAINING TEXTILE MATERIAL

For many years now cellulose-containing textile material or blends of cellulose fibers with synthetic fibers have been given a permanent, shape-stabilizing finish with crosslinkers in order that the textile material may return to its original shape after washing and drying without ironing (easy care). The known crosslinkers are chemical compounds which enter a more or less stable chemical bond with the free OH groups of the cotton.

They are commonly methylolated ureas, such as glyoxylurea derivatives. In general, to achieve complete crosslinking of the cellulose fiber, these compounds are used together with catalysts which also have the function of shortening the crosslinking time. Proven catalysts are in particular magnesium or aluminum compounds, in particular their water-insoluble halides. Since the reaction conditions of the crosslinking (140°–180° C. for 30 to 300 seconds) can bring about a cleavage of the methylol moiety of the molecule back to formaldehyde, there has of late been a trend toward the use of formaldehyde-free crosslinkers.

Recent work shows that polycarboxylic acids are capable of entering stable crosslinks with the cellulose under suitable reaction conditions.

U.S. Pat. No. 4,820,307 describes the use of polycarboxylic acids, such as maleic acid, citric acid or butanetetracarboxylic acid, in the presence of phosphorus-containing catalysts, such as alkali metal hypophosphites, phosphites, polyphosphates and dihydrogenphosphates, for crosslinking cellulose.

The use of phosphorus-containing catalysts in the crosslinking of cellulose-containing textile material using polycarboxylic acids is not without disadvantages. First, the high temperatures employed for the crosslinking or curing reaction can cause the evolution of hydrogen phosphide compounds, which have an unpleasant smell and constitute a health risk. Secondly, because of the increasing overfertilization of surface waters, the industry is as far as possible trying to replace phosphorus compounds.

Because of the known disadvantages, there continues to be interest in suitable catalysts for use in the crosslinking of cellulose-containing textile material.

It has surprisingly been found that boron-containing compounds, in particular boric acid and its salts, can be used as catalysts.

The present invention accordingly provides a process for the easy care finishing of cellulose-containing textile material by treating the cellulose-containing textile material with an aqueous liquor containing a polycarboxylic acid crosslinker and a crosslinking catalyst, then drying and heat treating, which comprises using boric acid or a derivative thereof as the crosslinking catalyst.

Cellulose-containing textile material for the purposes of the present invention includes for example woven fabrics, knitted fabrics, yarns and fibers at all possible stages of processing. They can consist of cellulose fibers or blends of cellulose fibers with other fibers, such as polyester fibers, polyamide fibers, acrylic fibers, polyolefin fibers or wool, in which case the blends have a cellulose content of more than 30%, preferably 50 to 90%.

Suitable crosslinking agents for the cellulose-containing textile material are aliphatic, alicyclic and aromatic carboxylic acids having at least 3 carboxyl groups, as mentioned in U.S. Pat. No. 4,820,307. Particularly suitable polycarboxylic acids are citric acid, propanetricarboxylic acid, cyclopentanetetracarboxylic acid, cyclohexanehexacarboxylic acid and in particular butanetetracarboxylic acid.

Suitable crosslinking catalysts are boric acid and its derivatives, such as its salts and esters. Suitable boric acids are metaboric acid ($HBO_2$), orthoboric acid ($H_3BO_3$) and polyboric acids of formula $H_{n-2}B_nO_{2n-1}$, where n is a natural number. The preferred salts of metaboric acid and orthoboric acid are the alkali metal and alkaline earth metal salts. Since the polyboric acids of the formula $H_{n-2}B_nO_{2n-1}$ are not preparable in the free state, preference is given to using the corresponding salts, such as alkali metal and alkaline earth metal salts. Examples are panderite, colemanite, ulexite, borocalcite, boracite and borax. The boric esters used according to the invention have the formula $B(OR)_3$, where R is preferably alkyl, in particular $C_1$–$C_6$alkyl, or aryl, preferably phenyl.

To confer easy care properties on the cellulose-containing textile material, it is treated with an aqueous liquor having a pH within the range from 2 to 5, preferably 3 to 4. The pH is set to that range, if necessary, by adding suitable bases, such as ammonia, alkali metal hydroxide or an aqueous solution thereof.

The aqueous liquor contains the aforementioned carboxylic acids as individual compounds or as mixtures in an amount of from 20 g to 150 g/l of liquor, and the crosslinking catalysts in an amount of from 0.5 to 100% by weight, based on the polycarboxylic acid.

The aqueous liquor may further contain customary auxiliaries, such as hydrophobicizers, softeners and fabric hand variators. This confers on the finished textile material not only additional specific properties, such as water repellency, oil repellency and a pleasant fabric hand, but frequently an additional improvement in the crease resistance.

The cellulose-containing textile material is treated with the aqueous liquor. The treatment usually takes the form of impregnation—the aqueous liquor being applied to the cellulose-containing textile material by slop-padding and the excess liquor then being squeezed off, usually to a wet pickup of 50%, preferably 70 to 80%. To impregnate the textile material, the components of the aqueous liquor can be jointly dissolved in water and applied to the cellulose-containing textile material, or each component is applied as a separate solution.

As well as impregnating, the treatment may be carried out by spraying, nip-padding or foaming the cellulose-containing textile material. These operations are very well known to those skilled in the art of the easy care finishing of textiles, and need not be described in greater detail.

After the cellulose-containing textile material has been treated, for example by impregnation, drying is carried out at a temperature of up to about 130° C., preferably 100° to 130° C., usually for 0.5 to 5 minutes.

This is followed at temperatures of about 130° to 190° C., preferably 160° to 180° C., by a heat treatment, which usually takes about 0.3 to 10 minutes, preferably 0.6 to 5 minutes.

The drying and the heat treatment are usually carried out in a tenter or in a through-circulation drying cabinet. Drying and heat treatment can also be carried out as one stage, for example by the STK-process (shock-drying-condensation) at a temperature within the range from 140° to 200° C. for a period of from 0.5 to 8 minutes.

USE EXAMPLES

100% cotton shirt poplin having a basis weight of 110 g/m$^2$ was impregnated with the aqueous liquors described in Table 1 by means of a slop-padder, squeezed off to a wet pickup of 70%, and then subjected to drying and heat treatment in a laboratory tenter (from Mathis, Zurich, Switzerland).

TABLE 1

| | | | | Application data | | | | | |
|---|---|---|---|---|---|---|---|---|---|
| | | Crosslinker | | Catalyst | | Drying | | Heat treatment | |
| Example | Crosslinker | amount (g/l) | Catalyst | amount (g/l) | Liquor pH | Temperature (°C.) | Time (s) | Temperature (°C.) | Time (s) |
| 1 | BTCA | 60 | $H_3BO_3$ | 5 | 2.5 | 110 | 180 | 180 | 90 |
| 2 | BTCA | 60 | $H_3BO_3$ | 5 | 3.0 | 110 | 180 | 180 | 90 |
| 3 | BTCA | 60 | $H_3BO_3$ | 5 | 4.0 | 110 | 180 | 180 | 90 |
| 4 | BTCA | 60 | $H_3BO_3$ | 5 | 5.0 | 110 | 180 | 180 | 90 |
| 5 | BTCA | 100 | $H_3BO_3$ | 4 | 3.5 | 110 | 180 | 160 | 300 |
| 6 | BTCA | 100 | $H_3BO_3$ | 4 | 3.5 | 110 | 180 | 170 | 180 |
| 7 | BTCA | 100 | $H_3BO_3$ | 4 | 3.5 | 110 | 180 | 180 | 60 |
| 8 | BTCA | 105 | $H_3BO_3$ | 3.5 | 3.5 | 110 | 180 | 180 | 90 |
| 9 | BTCA | 60 | NHP-1 | 2.5 | 2.2 | 110 | 180 | 180 | 90 |
| 10 | none | none | — | — | — | — | — | — | — |

BTCA: meso-1,2,3,4-butanetetracarboxylic acid
NHP-1: sodium hypophosphite monohydrate The technological properties of the fabrics thus finished were determined by the following methods following conditioning for at least 24 hours at 20° C. and 65% relative humidity:

DIN 53 890: determination of the crease recovery angle of textile sheet materials (measuring an air dried sample having a horizontal crease fold and a free limb pointing upward).

DIN 53 858: determination of the tensile strength of textile sheet materials (other than nonwovens); grab method.

The results of these determinations are summarized in Table 2.

TABLE 2

| | Technological effects | | |
|---|---|---|---|
| Example | Crease recovery angle (degrees) Initially | Crease recovery angle (degrees) 3 × 95° C. wash | Breaking strength (N) |
| 1 | 151 | 152 | 268 |
| 2 | 173 | 153 | 265 |
| 3 | 167 | 141 | 277 |
| 4 | 120 | 126 | 340 |
| 5 | 220 | 149 | 226 |
| 6 | 229 | 258 | 226 |
| 7 | 212 | 156 | 242 |
| 8 | 218 | 163 | 246 |
| 9 | 218 | 172 | 213 |
| 10 | 101 | 120 | 343 |

As can be seen from Table 2, boric acid catalysis gives comparable crease recovery values to those of catalysis with phosphorus-containing, inorganic salts, but at the same time higher strengths.

What is claimed is:

1. A process for the formaldehyde-free easy care finishing of cellulose-containing textile material by treating the cellulose-containing textile material with an aqueous liquor comprising a polycarboxylic acid crosslinker and a crosslinking catalyst, then drying and heat treating, wherein the improvement comprises using a crosslinking catalyst selected from the group consisting of boric acid, a salt of a polyboric acid, and a borate ester of the formula $B(OR)_3$, where R is alkyl or aryl.

2. The process of claim 1, wherein the polycarboxylic acid used is selected from the group consisting of citric acid, butanetetracarboxylic acid, cyclopentanetetracarboxylic acid and cyclohexanehexacarboxylic acid.

3. The process of claim 1, wherein the aqueous liquor has a pH of from 2.0 to 5.0.

4. The process of claim 1, wherein the concentration of the boric acid or boric acid derivative used is between 0.5 and 100% by weight, based on the polycarboxylic acid.

5. The process of claim 1, wherein the treatment of the cellulose-containing textile material is carried out by impregnating, spraying, nip-padding or foaming.

6. The process of claim 1, wherein the drying is carried out at a temperature of up to 130° C.

7. The process of claim 1, wherein the heat treatment is carried out at a temperature of between 140° and 200° C.

8. The process of claim 1, wherein the crosslinking catalyst used is selected from the group consisting of orthoboric acid, an alkali metal salt of a polyboric acid, and an alkaline earth metal salt of a polyboric acid.

9. The process of claim 1, wherein the aqueous liquor has a pH from 3.0 to 4.0.

10. The process of claim 1, wherein the drying is carried out at a temperature of 100° to 130° C.

11. The process of claim 1, wherein the heat treatment is carried out at a temperature of between 160° and 180° C.

* * * * *